US005297521A

United States Patent [19]

Sasaki et al.

[11] Patent Number: 5,297,521

[45] Date of Patent: Mar. 29, 1994

[54] THROTTLE VALVE CONTROLLER FOR INTERNAL COMBUSTION ENGINE

[75] Inventors: Yasushi Sasaki, Ibaraki; Yasuhiro Kamimura, Katsuta, both of Japan

[73] Assignee: Hitachi, Ltd., Japan

[21] Appl. No.: 997,697

[22] Filed: Dec. 28, 1992

[30] Foreign Application Priority Data

Dec. 26, 1991 [JP] Japan ..... 3-345237
Mar. 10, 1992 [JP] Japan ..... 4-051678

[51] Int. Cl.[5] ..... F02D 11/10
[52] U.S. Cl. ..... 123/396; 123/400
[58] Field of Search ..... 123/396, 399, 400, 403

[56] References Cited

U.S. PATENT DOCUMENTS

| | | | |
|---|---|---|---|
| 4,953,529 | 9/1990 | Pfalzgraf et al. | 123/396 |
| 5,016,589 | 5/1991 | Terazawa | 123/399 |
| 5,022,369 | 6/1991 | Terazawa | 123/399 |
| 5,076,231 | 12/1991 | Büchl | 123/399 |
| 5,141,070 | 8/1992 | Hickmann et al. | 123/396 X |
| 5,161,507 | 11/1992 | Terazawa et al. | 123/400 X |
| 5,163,402 | 11/1992 | Taguchi et al. | 123/396 |
| 5,172,667 | 12/1992 | Spiegel | 123/396 X |

FOREIGN PATENT DOCUMENTS 2-30933 2/1990 Japan .

*Primary Examiner*—Willis R. Wolfe
*Attorney, Agent, or Firm*—Evenson, McKeown, Edwards & Lenahan

[57] ABSTRACT

A throttle valve controller for use with an internal combustion engine has construction advantageous in terms of cost and enables, by a fail-safe function, "abnormal-state auxiliary driving" by the operation of an accelerator pedal in a case where an abnormality such as a failure has occurred in the actuator driving system. The risk of occurrence of a serious accident such as self-speeding of the vehicle is thereby eliminated substantially completely. A flexing driving force transmission mechanism or a fluid driving force transmission mechanism is provided at a driving force connection between a member displaced with the accelerator pedal operation and an opening/closing drive member of a throttle valve. The flexing driving force transmission mechanism absorbs the difference between the opening of the throttle valve controlled with the actuator and the opening to which the throttle valve is to be set by the accelerator pedal operation.

14 Claims, 11 Drawing Sheets

THROTTLE VALVE CONTROLLER FOR INTERNAL COMBUSTION ENGINE

BACKGROUND OF THE INVENTION

This invention relates to a throttle valve controller for an internal combustion engine, having an actuator for opening/closing a throttle valve and having a fail-safe function such that, while the opening of the throttle valve is controlled with the actuator in an ordinary state, the actuator is disconnected from the throttle valve to enable a throttle valve opening control performed by operating an accelerator pedal in an abnormal state and, more particularly, to an internal combustion engine throttle valve controller suitable for motor vehicle engines.

Recently, electronic throttling type of throttle valve controllers, which now attract attention, have been provided as new throttle valve control systems for internal combustion engines mounted on vehicles, e.g., motor vehicles, to be used in place of the conventional direct throttle valve operation. In this control system, the throttle valve is controlled to be opened and closed by an actuator such as an electronic motor into which an operation amount of the accelerator pedal is fed as an electronic signal provided by a sensor after computing of the signal. Such an electronic-throttling type of throttle valve controllers have been noted. Such controllers have found applications to various kinds of engine control such as traction control effective in improving the vehicle performance, e.g., the engine power.

For electronic throttling type of throttle valve controllers, a function for ensuring a sufficient degree of safety even when an abnormality of the controller or an actuator used with the controller occurs, i.e., a fail-safe function, is indispensable.

Japanese Patent Unexamined Publication No. 2-30933 discloses a technique for achieving such a fail-safe function in such a manner that electromagnetic clutches are provided for both the connections of the throttle valve to the actuator and the accelerator pedal. The clutch on the actuator side is engaged in an ordinary state to enable an electronic control of the throttle valve with the actuator, i.e., an operation in an electronic throttling mode, and the clutch on the accelerator pedal side is alternatively engaged to enable a direct throttle valve control with the accelerator pedal in an abnormal state where an abnormality, such as a malfunction of the actuator system, has occurred. That is, an "abnormal-state auxiliary drive" mode is selected to continue driving the vehicle to a repair shop or the like in spite of the abnormality, however, the driving performance may be.

As techniques related to this kind of electronic throttling, those disclosed in U.S. Pat. Nos. 5,016,589, 5,022,369, and 5,076,231 are known. Each of these related techniques, however, was developed without considering the occurrence of a state in which the throttle valve opening provided by the actuator is controlled to be closer to the open limit than the opening to which the throttle valve is set by the accelerator pedal operation. If, in such a state, an abnormality occurs in the actuator system, the throttle valve cannot be returned to the fully-closed position when the accelerator pedal is completely released. There is raised such a problem that the performance of the fail-safe function based on these techniques is thus unsatisfactory.

In conventional techniques, if an abnormality occurs in the actuator system, the electromagnetic clutch on the actuator side is disengaged while the electromagnetic clutch on the accelerator pedal side is engaged, thereby forming an "abnormal-state auxiliary drive" mechanism. At this time, however, if the throttling system is in a state such as that described above, the throttle valve having an opening greater than the opening corresponding to the accelerator pedal operation position is directly connected to the accelerator pedal, and the throttle valve cannot be fully closed by releasing the accelerator pedal. That is, there is a possibility of a serious accident, i.e., self-speeding of the vehicle. Thus, a complete fail-safe function has not been achieved.

Moreover, the above-described conventional techniques were developed without sufficiently considering cost reduction means. They require two clutches and therefore entail the problem of a high manufacturing cost.

An object of the present invention is to provide an internal combustion engine throttle valve controller having a construction advantageous in terms of cost and enabling, by a fail-safe function, "abnormal-state auxiliary driving" performed by the accelerator pedal operation in a case where an abnormality such as a failure has occurred in the actuator driving system, whereby the risk of occurrence of a serious accident such as self-speeding of the vehicle can be eliminated substantially completely.

To achieve this object, one of a flexing driving force transmission mechanism and a fluid driving force transmission mechanism is provided at a driving force connection between a member displaced with the operation of an accelerator pedal and an opening/closing drive member of a throttle valve to absorb the difference between the opening of the throttle valve controlled with the actuator and the opening to which the throttle valve is to be set by the accelerator pedal operation.

Each of the flexing driving force transmission mechanism and a fluid driving force transmission mechanism serves to cancel out the influence of the operated position of the accelerator pedal by absorbing a movement of the throttle valve caused by the actuator and to enable the throttle valve to be opened/closed through the accelerator pedal while equalizing the throttle valve opening to the opening set by the accelerator pedal, when the actuator is disconnected from the throttle valve by the driving force connection/ disconnection means.

In a case where an abnormality such as failure has occurred in the actuator driving system, the throttle valve operation by the accelerator pedal is enabled to provide for an "abnormal-state auxiliary drive" function, while the throttle valve is returned to the accelerator pedal operated position by balancing of springs constituting the flexing driving force transmission mechanism or by the fluid driving force transmission mechanism. It is thereby possible to prevent occurrence of a serious accident such as self-speeding of the vehicle during "abnormal-state auxiliary driving" and to achieve a complete fail-safe function and improved reliability of the control system.

Only one electromagnetic clutch will suffice to constitute the driving force connection/disconnection apparatus. Therefore the arrangement of the present invention is also advantageous in terms of cost.

DESCRIPTION OF THE PREFERRED EMBODIMENTS

Figure 1:
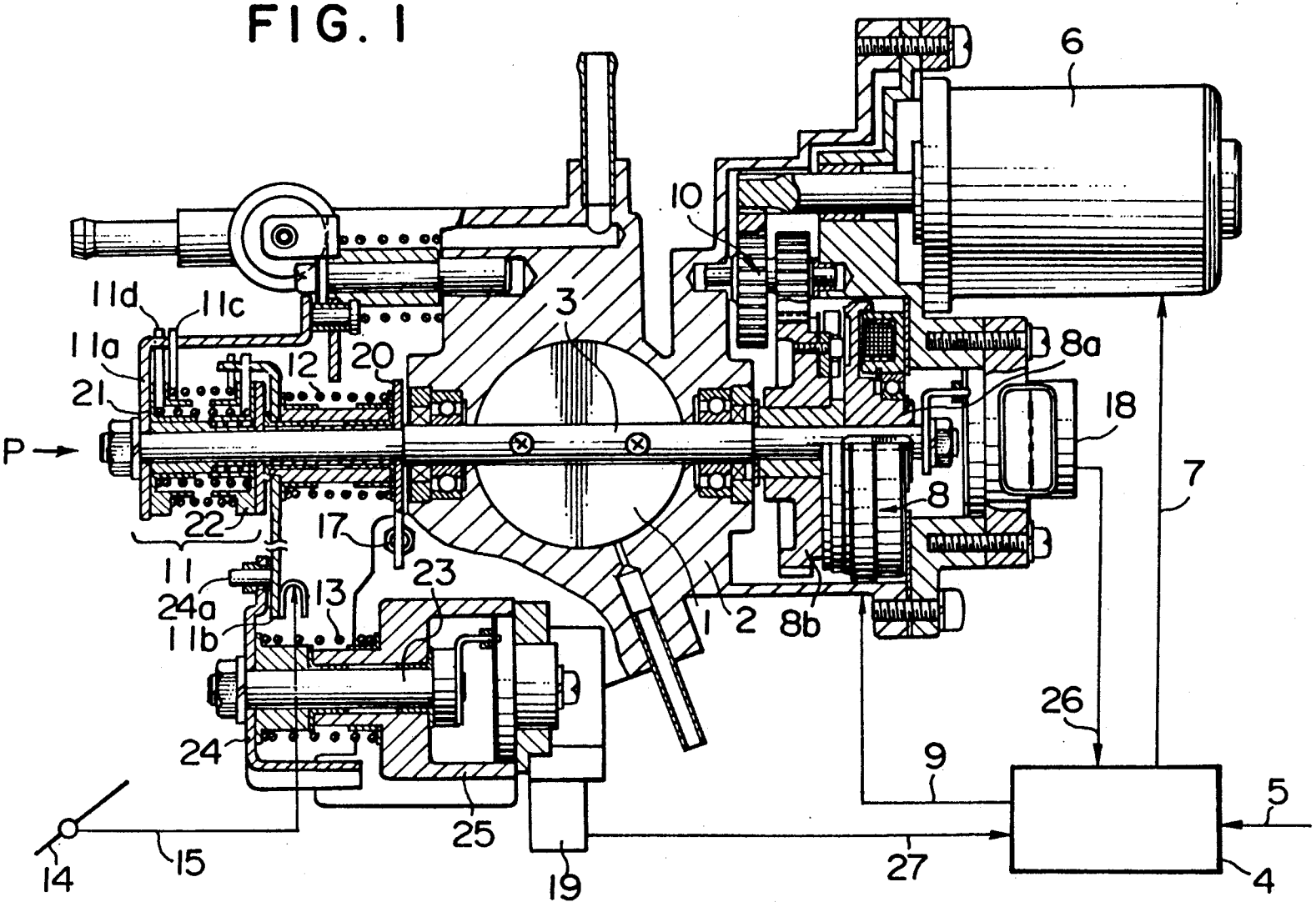
FIG. 1 is a partial sectional view of a throttle valve controller for an internal combustion engine in accordance with a first embodiment of the present invention.

FIG. 1 illustrates a first embodiment of a throttle valve 1 fixed on a throttle valve shaft 3 which is rotatably supported on a support (throttle body) 2.

A numeral 4 denotes a control unit and a numeral 6 denotes a motor serving as an actuator for controlling the opening of the throttle valve 1. The control unit 4 is supplied with a target opening 5 set on the basis of various information items indicating operating conditions of an engine. A drive signal 7 is then transmitted from the control unit 4 to the motor 6.

An electromagnetic clutch 8 is operated by an excitation signal 9 from the control unit 4, and constitutes a driving force connection/disconnection apparatus for controlling transmission/cutting of driving force between the throttle valve shaft 3 and the motor 6.

A rotor 8*a* of the electromagnetic clutch 8 is attached to the throttle valve shaft 3, and an input gear 8*b* of the electromagnetic clutch 8 is arranged so as to be rotatable relative to the throttle valve shaft 3. The driving force is transmitted from the motor 6 to the electromagnetic clutch 8 through a reduction gear 10 meshing with the gear 8*b*.

A spring driving force transmission mechanism 11 is constituted of a control lever 11*a* attached to the throttle valve shaft 3, a throttle lever 11*b* connected to an accelerator pedal 14 through an accelerator wire 15, and two lost-motion springs 11*c* and 11*d*. The throttle valve 11*b* and the control lever 11*a* are connected to each-other through the lost-motion springs 11*a* and 11*d*.

A return spring 12 is provided on the throttle lever 11*b*. The throttle valve 1 is thereby urged in a closing direction.

A throttle position sensor 18 serves as a detection device for detecting the actual opening of the throttle valve 1. An accelerator position sensor 19 serves for detecting the operated position of the throttle lever 11*b*.

An adjustment bar 20 is fixed to the throttle valve shaft 3 and serves to limit the range of rotation of the throttle valve 1 by engaging with a full-opening stopper 16 and a full-closure stopper 17. A full-opening stopper 16 is shown schematically in FIG. 3.

Spring receivers 21 and 22 are formed of a material such as a resin having a small friction factor to reduce the sliding resistance of the lost-motion springs 11*c* and 11*d* disposed on the spring receivers 21 and 22.

An accelerator position sensor shaft 23 is rotatably inserted into and supported on a sensor housing 25, and a lever 24 is attached to the accelerator position sensor shaft 23. The lever 24 is engaged with the throttle lever 11*b* through a connection pin 24*a* and therefore can rotate by following the rotation of the throttle lever 11*b* to the accelerator position sensor 19. As this time, a play in the rotation transmission system is eliminated by a return spring having a comparatively small returning force and provided on the accelerator position sensor shaft 23.

A voltage output 16 from the throttle position sensor 18 is input to a control unit 4, and the drive signal 7 determined by comparing the value of the voltage output 26 representing the actual opening of the throttle valve 1 and the target opening is transmitted from the control unit 4 to the motor 6, thereby effecting a feedback control of the throttle valve 1.

When the control by the motor 6 is stopped, a certain correlation existing basically between the voltage output 26 from the throttle position sensor 18 and a voltage output 27 from the accelerator position sensor 19 is input to the control unit 4 to effect comparison-determination as to whether the normal operation is being performed, thereby enabling a fail-safe control.

However, the fail-safe control logic described here is only an example and is not exclusively used to practice the basic concept of the present invention.

Figure 2:
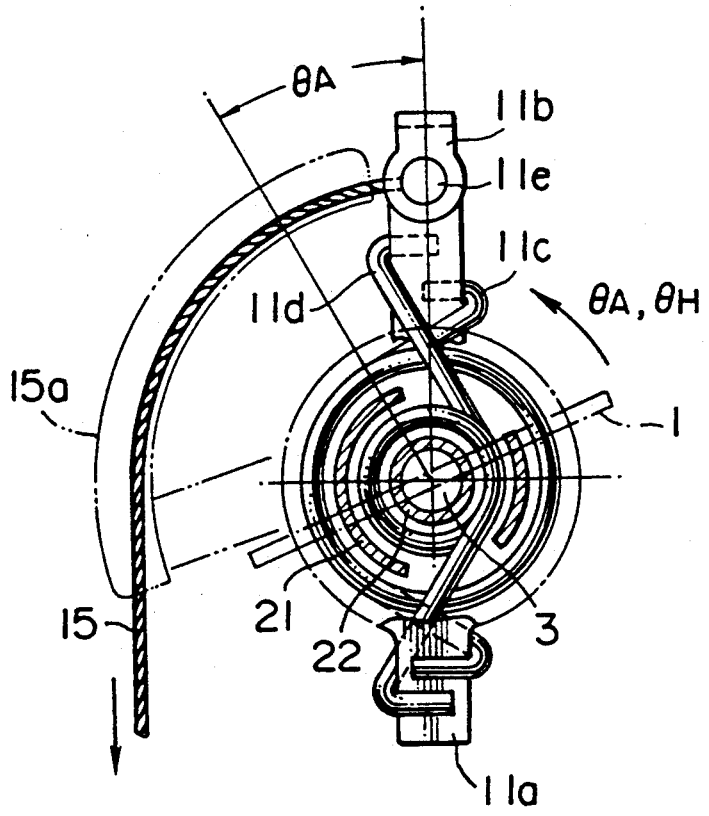
FIG. 2 is a side view of a portion of the throttle valve controller shown in FIG. 1.

FIG. 2 is a diagram of the spring driving force transmission mechanism 11 as viewed in a direction P of FIG. 1. The throttle valve 1 is fixed to the throttle valve shaft 3, and the control lever 11*a* is also fixed to the throttle valve shaft 3 and therefore rotates integrally with the throttle valve 1.

The throttle lever 11*b* is rotatably supported on the throttle valve shaft 3, and the lost-motion springs 11*c* and 11*d* are mounted on the spring receivers 21 and 22 so as to have urging forces applied in opposite directions. Accordingly, the springs 11*c* and 11*d* are therefore disposed so as to have displacements caused by the throttle lever 11*b* in opposite directions, and so as to be preliminarily stressed or biased.

The accelerator wire or cable 15 is led through a wire guide channel 15*a* of the throttle lever 11*b* and is fixed to the throttle lever 11*b* by a round shaped end 11*e*. Through the accelerator wire 15, the throttle valve 1 can be rotated in the direction of arrow $\theta_A$ against the urging force of the return spring 12 by the operation of the accelerator pedal 14.

The operation of the embodiment shown in FIGS. 1 and 2 will now be described below with reference to a schematic construction diagram of FIG. 3.

Figure 3:
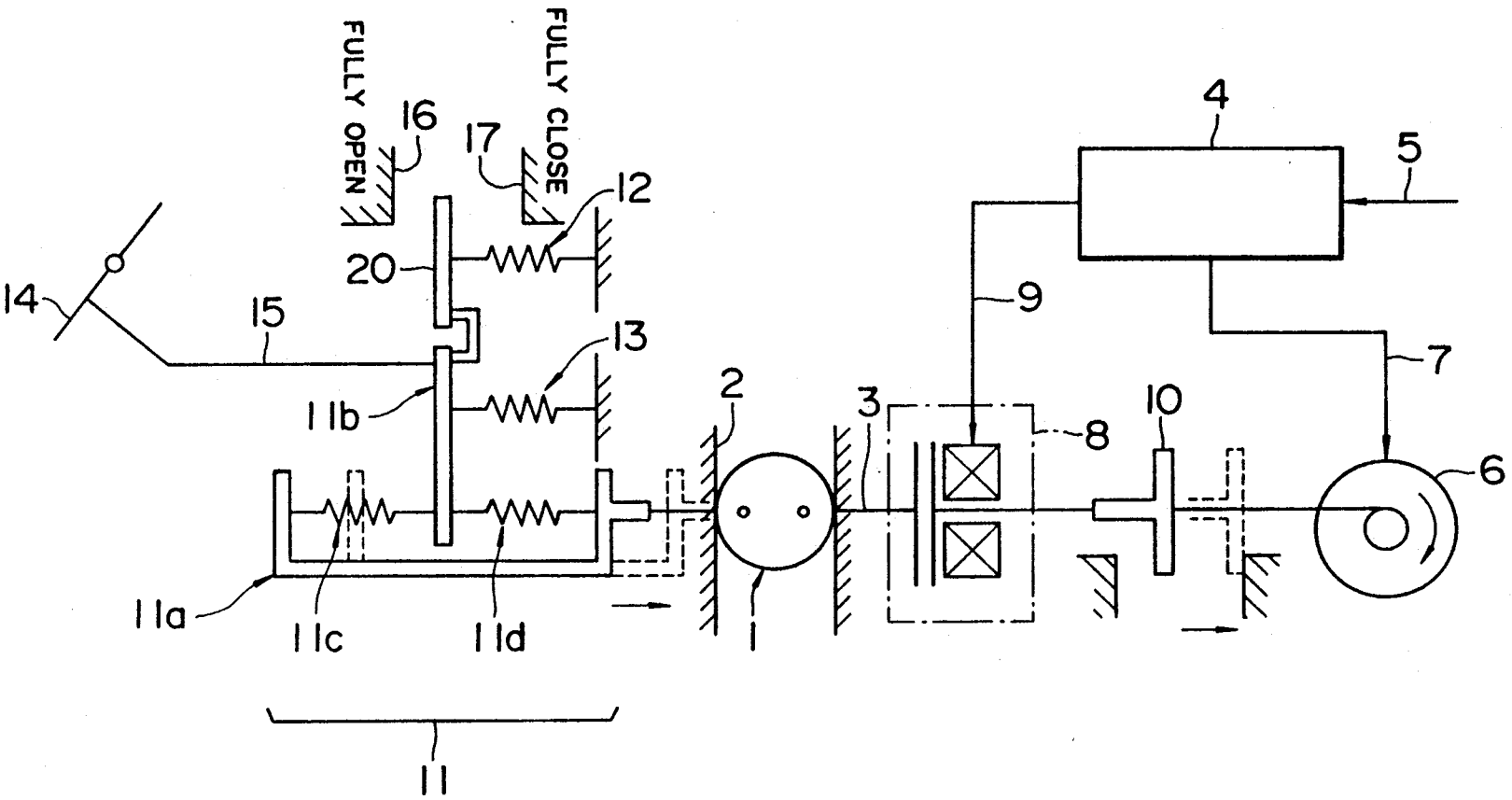
FIG. 3 is a schematic construction diagram of the principle of the first embodiment of the invention.

In FIG. 3, for ease of understanding, the rotary motions of FIG. 1 are represented by rectilinear motions to the left or right, and the components identical or corresponding to those shown in FIG. 1 are indicated by the same reference characters.

Referring to FIG. 3, when the driver turns on a key switch (not shown), the excitation signal 9 is simultaneously transmitted to the electromagnetic clutch 8, the electromagnetic clutch 8 is thereby set in an on-state, i.e., a ready state under an ordinary control, and the drive signal 7 is transmitted from the control unit 4 to the motor 6, thereby controlling the opening/ closing of the throttle valve 1.

At this time, the control lever 11*a* attached to the throttle valve shaft 3 is moved (rotated) integrally with the throttle valve 1 by the rotation of the motor 6, as indicated by the broken line in FIG. 3. The relative displacement of the throttle lever 11*b* caused by this movement (rotation) of the control lever 11*a* is absorbed by the extension of one of the other of these springs (unwinding of one of these springs and winding-up of the other in FIG. 1). Consequently, the opening/-closing control of the throttle valve 1 through the motor 6 is possible independently of the operated position of the throttle lever 11*b* determined by the extent of depression of the accelerator pedal 14, and the throttle valve 1 can be operated in an electronic throttling mode.

It is assumed here that an abnormality such a failure in the motor driving system has occurred during this operation for some reason.

Then, the excitation of the electromagnetic clutch 8 is first stopped by the operation of an abnormality diagnosis function of the control unit 4 and is maintained in an off-state.

The throttle valve shaft 3 is thereby disconnected from the motor 6 to be free.

If at this time a relative displacement is left between the throttle lever 11*b* and the control lever 11*a*, there is a difference between the urging loads of the lost-motion springs 11*c* and 11*d*, and the control lever 11*a* is moved (rotated) by the operation of the springs 11*c* and 11*d* to a position at which the difference between these urging loads is zero, that is, the relative displacement is zero. The throttle valve 1 is thereby moved (rotated) to have an opening in accordance with the operated position of the accelerator pedal 14.

As a result of this movement, the throttle valve shaft 3 is set in a state of being connected to the accelerator pedal 14 alone through the control lever 11*a*, the lost-motion springs 11*c* and 11*d* and the throttle lever 11*b*, thereby preparing for the operation of driving the throttle valve 1 by the accelerator pedal 14.

Thereafter, the throttle lever 11*b* can be rotated against the restoring forces of the return springs 12 and 13 by depressing the accelerator pedal 14. With this movement (rotation) of the throttle lever 11*b*, the control lever 11*a* receives a force such that the loads upon the lost-motion springs 11*c* and 11*d* are balanced. The control lever 11*a* therefore follows the throttle lever 11*b* to move (rotate) in phase with the same, thereby enabling a throttle valve 1 opening control and achieving an "abnormal-state auxiliary drive" function.

Figure 4:
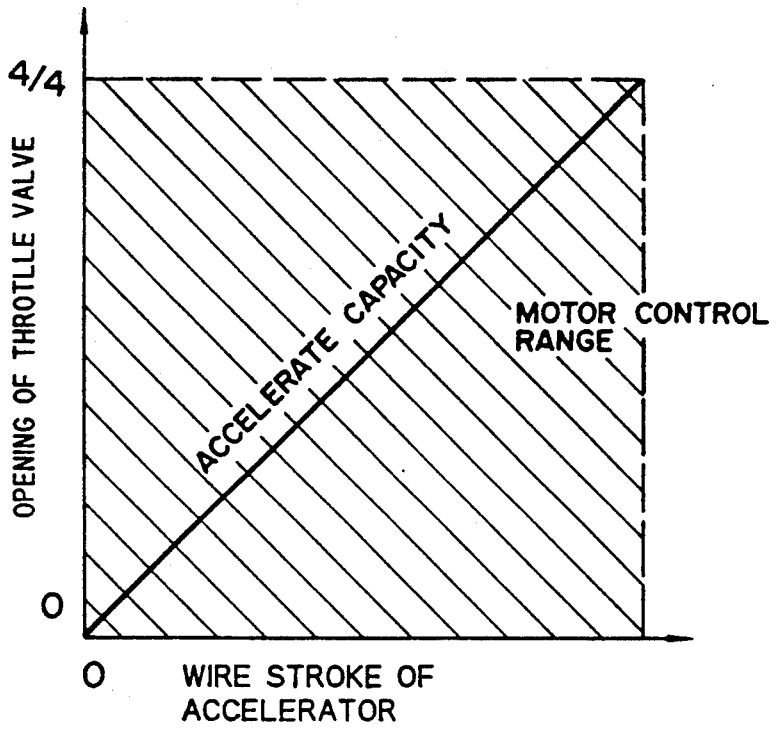
FIG. 4 is a characteristic diagram showing a controllable range in accordance with the present invention.

FIG. 4 shows a controllable range of the above-described embodiment. As is apparent from FIG. 4, the throttle valve 1 can be controlled with the motor 6 through the overall range of its opening. It is also understood that the possible control range is the same as that of the conventional art in the "abnormal-state auxiliary drive" mode, and that a control in compliance with the acceleration pedal operation can be effected.

Thus, in accordance with this embodiment, at the time of occurrence of an abnormality, the motor 6 is disconnected from the throttle valve shaft 3 to automatically change the throttling operation into the mode under the opening control using the accelerator pedal 14 to change the opening of the throttle valve 1 by the operation of the accelerator pedal 14 while automatically setting the opening in accordance with the operated position of the accelerator pedal 14, thereby staring the "abnormal-state auxiliary drive" function. Since the throttle valve is returned to the accelerator pedal operated position at this time, the occurrence of a serious accident such as self-speeding of the vehicle during "abnormal-state auxiliary driving" can be prevented, thus achieving a complete fail-safe function and improved reliability of the control system.

Figure 5:
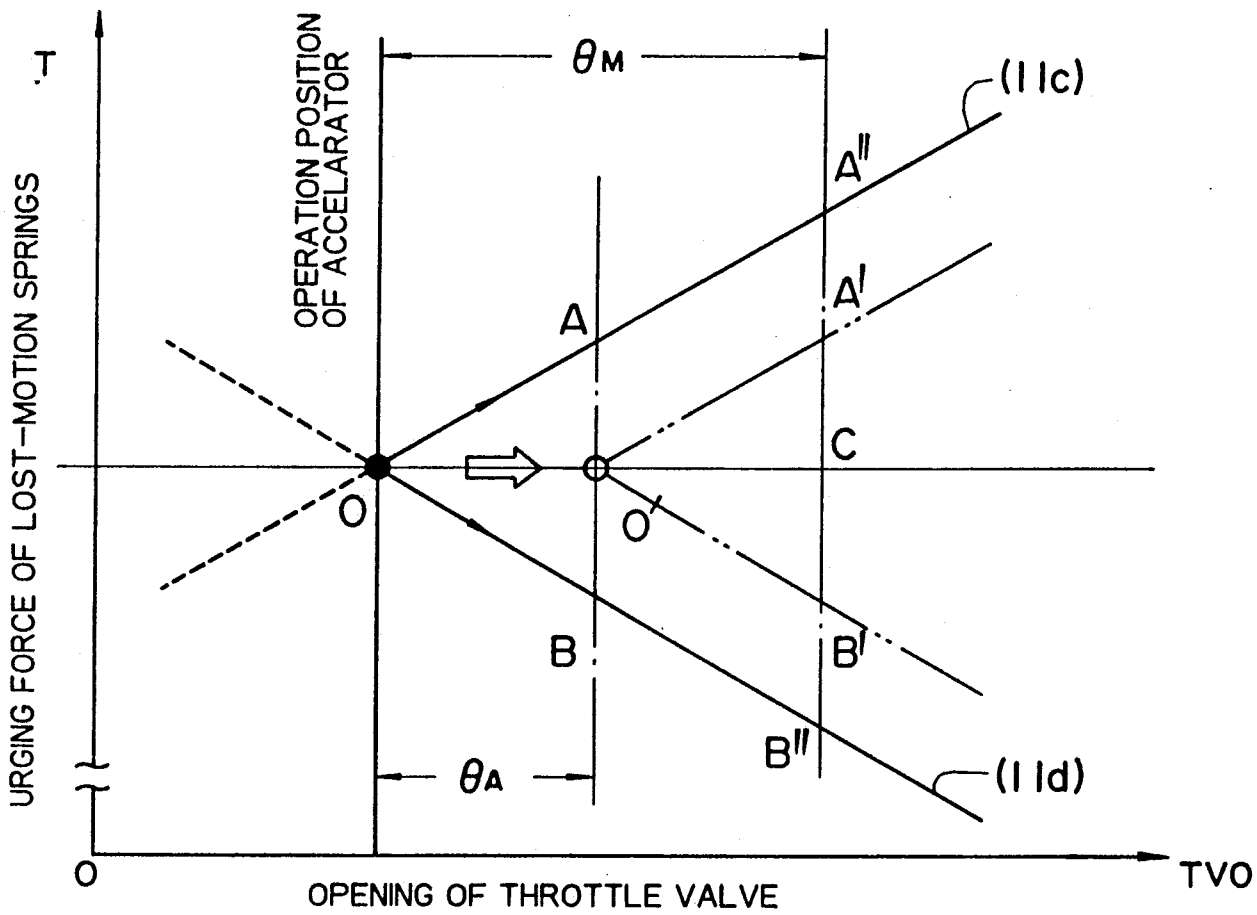
FIG. 5 is a characteristic diagram of a spring driving force transmission mechanism of the first embodiment of the invention.

FIG. 5 is a schematic diagram of the operation of the spring driving force transmission mechanism 11 in accordance with the foregoing embodiment with respect to the control using the motor 6 and the control based on operating the accelerator pedal 14. In FIG. 5, the abscissa represents the opening TVO of the throttle valve 1 while the ordinate represents the urging torque T of the lost-motion springs 11*c* and 11*d*.

A point 0 in FIG. 5 indicates a neutral (initial) state. It is assumed here that, at the point 0, the throttle valve opening TVO has a value in accordance with the operated position of the accelerator pedal.

First, in a state where the throttle valve 1 is controlled with the motor 6 to be set to an angle of $\theta_M$ degrees toward the opening limit, the lost-motion spring 11*c* is displaced in one angular direction to be wound up, while the other lost-motion spring 11*d* is displaced in the opposite angular direction to be unwound. Accordingly, a characteristic line 0 - A" shown in FIG. 5 represents a corresponding urging torque T characteristic of the spring 11*c*, and a characteristic line O - B" represents a corresponding urging torque T characteristic of the spring 11*d*. The absolute value of A"- B" indicates the necessary torque to be generated by the motor 6.

This is a description for the control of the throttle valve 1 in the opening direction, and the same description can be made the control in the closing direction.

Next, a situation where the "abnormal-state auxiliary drive" function of the spring driving force transmission mechanism 11 is activated from the state corresponding to the point 0 in FIG. 5 will be described below.

If the throttle lever 11*b* is rotated in the opening direction through an angle of $\theta_A$ degrees by the operation of the accelerator pedal 14, the springs 11*c* and 11*d* are moved relative to each other in a direction such as to be balanced in the urging torque T thereof. The control lever 11*a* is rotated in the same direction with the rotation of the throttle lever 11*b*, as represented by a movement from the point 0 to a point O' in FIG. 5, and the throttle valve 1 rotates in the opening direction through the same angle of $\theta_A$ degrees. Thus, even if an abnormality occurs in the driving system, including an abnormality in the motor 6, an "abnormal-state auxiliary drive" mechanism can be reliably established.

Ordinarily, if no clutch or the like is provided on the accelerator pedal 14 side, a kick-back phenomenon of the accelerator pedal 14 occurs when the throttle valve 1 is controlled with an actuator such as motor 6.

In this embodiment, however, two springs 11*c* and 11*d* are used as lost-motion springs and are assembled so as to have urging torques in opposite directions. According to this embodiment, therefore, urging torque constants of the springs 11*c* and 11*d* are set to equal values to make a composite torque of these torques flat, thereby obtaining a characteristic O - C shown in FIG. 5. It is thereby possible to prevent the kick-back phenomenon.

The second embodiment of the present invention will be described below with reference to a schematic diagram of FIG. 6 similar to FIG. 3.

Figure 6:
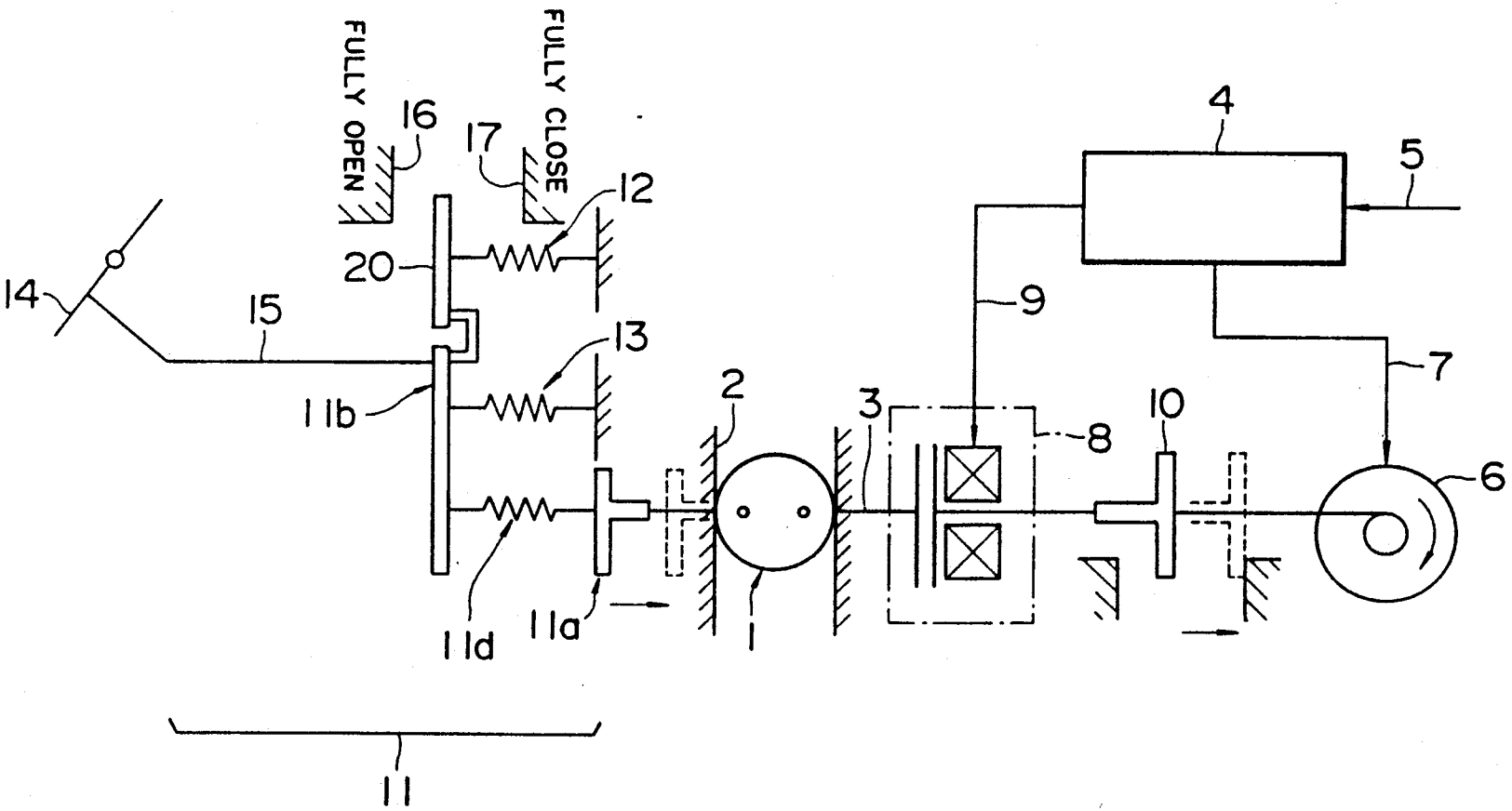
FIG. 6 is a schematic diagram of the construction of a second embodiment of the present invention.

In the second embodiment schematically shown in FIG. 6, a spring driving force transmission mechanism is also constructed by using a lost-motion spring, as in the case of the arrangement schematically shown in FIG. 3. However, the second embodiment differs from the first embodiment in that only one lost-motion spring 11*d* constitutes a spring driving force transmission mechanism.

This spring 11*d* is arranged as to be able to displaced in a plus (rightward) direction or a minus (leftward) direction from a neutral position as shown in FIG. 6, i.e., from a state in which no tension is produced. By this arrangement, when the control lever 11*a* is moved (rotated) integrally with the throttle valve 1 by the rotation of the motor 6 as indicated by the dotted line in FIG. 6, the displacement of the control lever 11*a* relative to the throttle lever 11*b* thereby caused is absorbed by the extension/contraction of the lost-motion spring 11*d*, as in the case of the embodiment shown in FIG. 3. Consequently, the opening/closing control of the throttle valve through the motor 6 is possible independently of the operated position of the throttle lever 11*b* determined by the extent of depression of the accelerator pedal 14, and the throttle valve 1 can be operated in an electronic throttling mode.

On the other hand, the driving operation in the case of an abnormality such as a failure in the motor driving system and with respect to the "abnormal-state auxiliary drive" mechanism is the same as the arrangement schematically shown in FIG. 3, and the description for it will not be repeated.

The third embodiment of the present invention will be described below with reference to a schematic diagram of FIG. 7.

Figure 7:
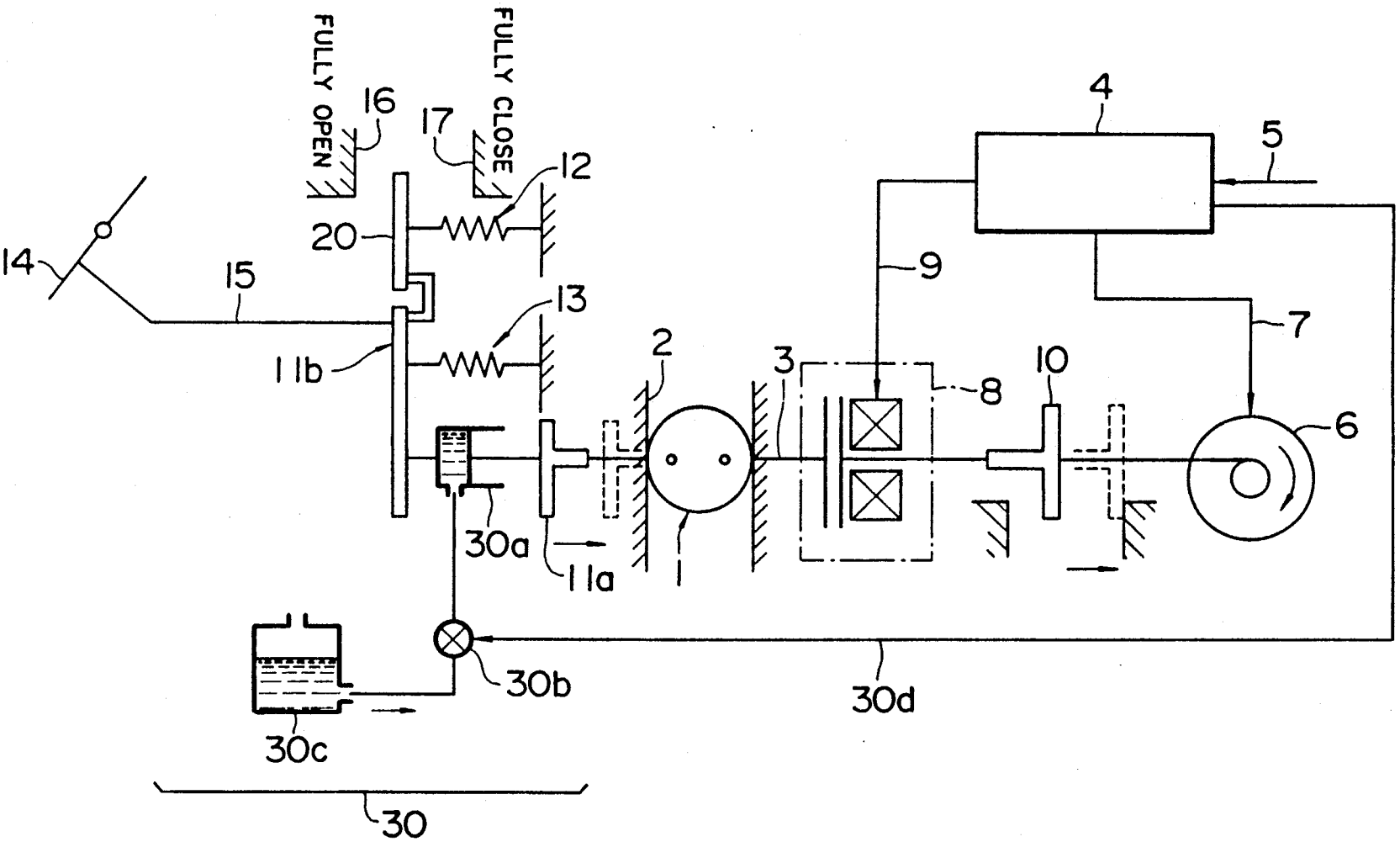
FIG. 7 is a schematic diagram of the construction of a third embodiment of the present invention.

This embodiment is arranged in such a manner that a fluid driving force transmission mechanism 30 is used in place of the flexing driving force transmission mechanisms of the embodiments shown in FIGS. 1 to 6, as shown in FIG. 7. The fluid driving force transmission mechanism 30 is formed by a hydraulic cylinder 30*a*, an electromagnetic valve 30*b*, and a fluid reservoir 30*c*. The opening/closing of the electromagnetic valve 30*b* is controlled by a drive signal 30*d* from the control unit 4.

The hydraulic cylinder 30*a* is provided to connect the control lever 11*a* and the throttle lever 11*b*. A chamber defined between a cylinder bore and a piston of the hydraulic cylinder 30*a* is filled with an operating fluid communicating with the fluid stored in the fluid reservoir 30*c* through the electromagnetic valve 30*b*.

Accordingly, when the electromagnetic valve 30*b* is open, the fluid can enter or exit out of the hydraulic cylinder 30*a* freely, and the piston is therefore free with respect to the cylinder, thereby enabling the control lever 11*a* to move freely relative to the throttle lever 11*b*.

When the electromagnetic valve 30*b* is closed, the entrance/exit of the fluid in the hydraulic cylinder 30*a* is inhibited, and the position of the piston is thereby fixed relative to the cylinder, so that the control lever 11*a* is in a state of being connected to the throttle lever 11*b*.

Also in this embodiment, a throttle position sensor 18 and an accelerator position sensor 19 are also provided as in the case of the embodiment shown in FIG. 1. Voltages outputs 26 and 27 from these sensors are input to the control unit 4.

The operation of the embodiment shown in FIG. will be described below.

In the electronic throttling operation mode of controlling the opening/closing by the motor 6, the control unit 4 controls the electromagnetic valve 30*b* by the drive signal 30*d* so that the electromagnetic valve 30*b* is open. The control lever 11*a* is thereby released from the throttle lever 11*b*, thereby enabling the operation in the electronic throttling mode with a high reliability.

On the other hand, in a case where an abnormality has occurred, the control unit 4 examines the voltage output 26 from the throttle position sensor 18 and the voltage output 27 from the accelerator position sensor 19, and disengages the electromagnetic clutch 8 and, in parallel with this operation, closes the electromagnetic valve 30*b* when the actual opening of the throttle valve 1 coincides with the opening in accordance with the operated position of the accelerator pedal 14. The control of the throttle valve 1 is thereby changed from the mode using the motor 6 to the mode using the accelerator pedal 14, thereby achieving the correct operation in the "abnormal-state auxiliary drive" mode.

Figure 8:
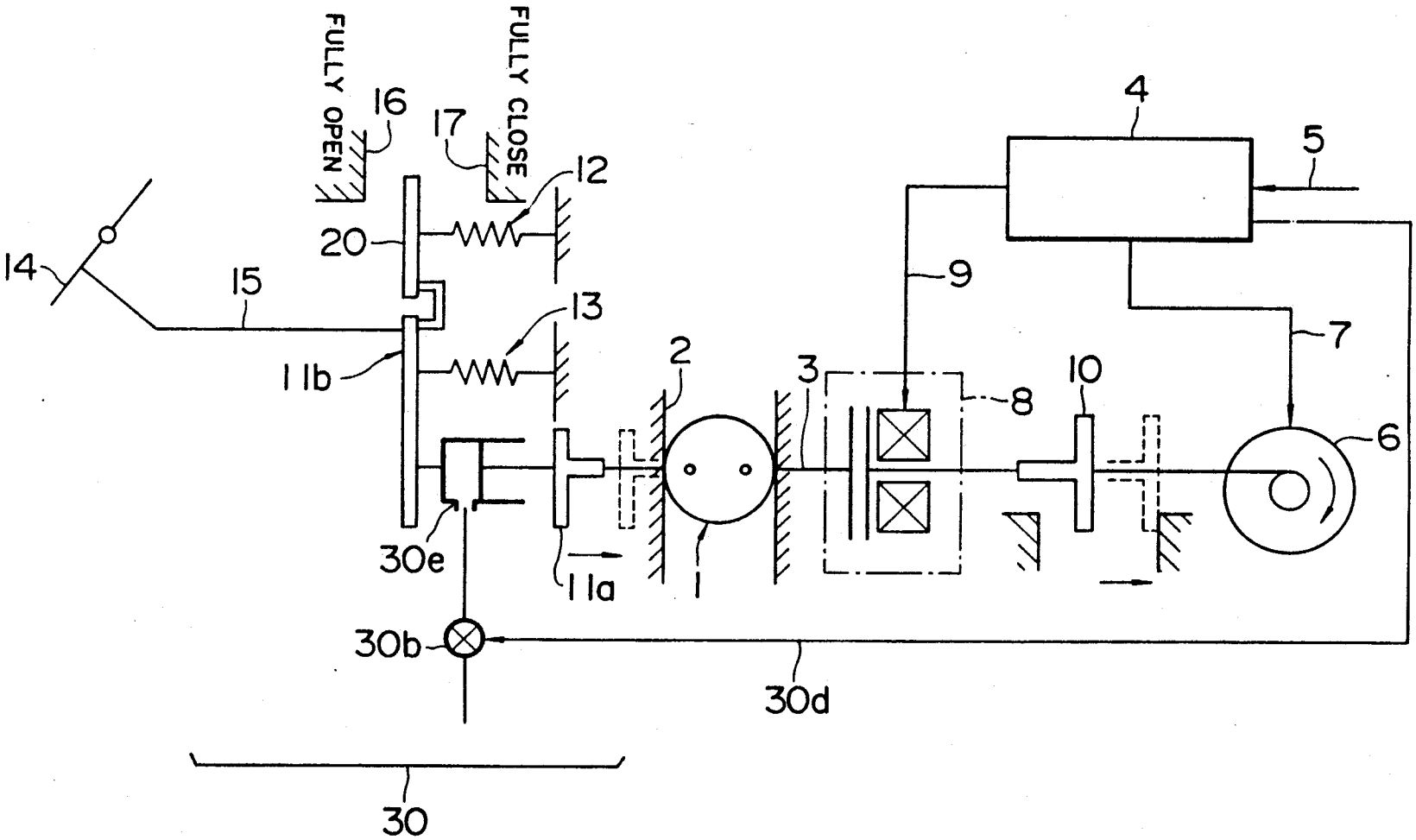
FIG. 8 is a schematic diagram of the construction of a fourth embodiment of the present invention.

FIG. 8 is a schematic diagram of the construction of the fourth embodiment of the present invention. This embodiment is arranged in such a manner that the hydraulic cylinder 30*a* in the embodiment shown in FIG. 7 is replaced by a pneumatic cylinder 30*e* and, correspondingly, the fluid reservoir is removed. Therefore, the other components and the operation of this embodiment are the same as the FIG. 7 embodiment, and the description for them will not be repeated.

In the FIG. 8 embodiment, the need for a fluid and a fluid reservoir is eliminated, so that the price of the controller can be reduced in comparison with the embodiment of FIG. 7.

Figure 9:
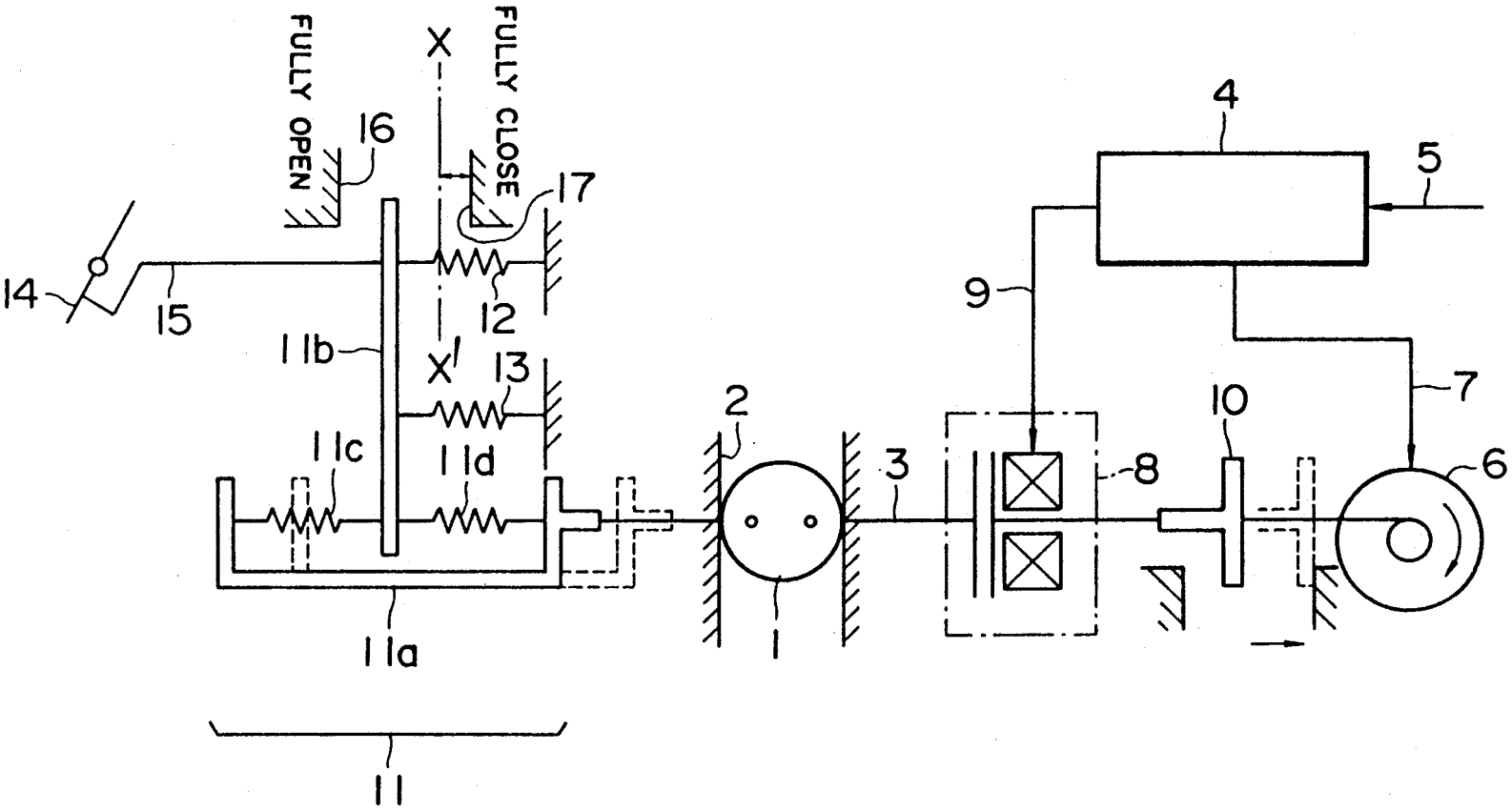
FIG. 9 is a schematic construction diagram of the principle of the operation of a fifth embodiment of the present invention.

FIG. 9 shows the fifth embodiment of the present invention. In this embodiment, when the operator turns on a key switch (not shown), the excitation signal 9 is simultaneously transmitted to the electromagnetic clutch 8, the electromagnetic clutch 8 is thereby set in an on-state, i.e., a ready state under the ordinary control, and the drive signal 7 is transmitted from the control unit 4 to the motor 6, thereby controlling the opening/closing of the throttle valve 1.

At this time, the control lever 11*a* attached to the throttle valve shaft 3 is moved (rotated) integrally with the throttle valve 1 by the rotation of the motor 6, as indicated by the broken line in FIG. 9. The relative displacement of the throttle lever 11*b* caused by this movement (rotation) of the control lever 11*a* is absorbed by the extension of one of the lost-motion springs 11*c* and 11*d* and the contraction of the other of these springs (unwinding of one of these springs and winding-up of the other in FIG. 1). Consequently, the opening/closing control of the throttle valve 1 through the motor 6 is possible independently of the operated position of the throttle lever 11*b* determined by the extent of depression of the accelerator pedal 14, and the throttle valve 1 can be operated in the electronic throttling mode.

It is assumed here that the abnormality, such, as a failure in the motor driving system, has occurred during this operation for some reason.

Then, the excitation of the electromagnetic clutch 8 is first stopped by the operation of an abnormality diagnosis function of the control unit 4 and is maintained in an off state.

The throttle valve shaft 3 is thereby disconnected from the motor 6 to be free.

If at this time a relative displacement is left between the throttle lever 11*b* and the control lever 11*a*, there is a difference between the urging loads of the lost-motion springs 11*c* and 11*d*, and the control lever 11*a* is moved (rotated) by the operation of the springs 11*c* and 11*d* to the position at which the difference between these urging loads is zero, that is, the relative displacement is zero. The throttle valve 1 is thereby moved (rotated) to have an opening in accordance with the operated position of the accelerator pedal 14.

As a result of this movement, the throttle valve shaft 3 is set in a state of being connected to the accelerator pedal 14 alone through the control lever 11*a*, the lost-motion springs 11*c* and 11*d* and the throttle lever 11*b*, thereby preparing for the operation of driving the throttle valve 1 by the accelerator pedal 14.

Thereafter, the throttle lever 11*b* can be rotated against the restoring forces of the return springs 12 and 13 by depressing the accelerator pedal 14. With this movement (rotation) of the throttle lever 11*b*, the control lever 11*a* receives a force such that the load upon the lost-motion springs 11*c* and 11*d* are balanced. The control lever 11*a* therefore follows the throttle lever 11*b* to move (rotate) in phase with the same, thereby enabling a throttle valve 1 opening control and achieving an "abnormal-state auxiliary drive" function.

Referring to FIG. 9, the position of the throttle lever 11*b* indicated by the dot-dash line X—X' in FIG. 9 represents a position corresponding to the fully-closed limit of the opening of the throttle valve 1, i.e., an idling opening while the loads upon the lost-motion springs 11*c* and 11*d* are balanced, i.e, at the neutral position.

On the other hand, in the arrangement of this embodiment, the full-closure position of the throttle lever 11*b*, which is determined by the full-closure stopper 17 when the accelerator pedal 14 is returned, is shifted from the position indicated by the dot-dash line X - X' by a predetermined angle $\alpha$ in the returning direction.

In this embodiment, therefore, when the accelerator pedal 14 is returned to the position at which the stroke is zero, the throttle lever 11*b* passes the position corresponding to the full-closure opening (idling opening) of the throttle valve 1 and returns to the full-closure position determined by the full-closure stopper 17. The lost-motion springs 11*c* and 11*d* are thereby displaced from the neutral position to an extent corresponding to the angle $\alpha$ to produce a resiliency force corresponding to this displacement. The throttle lever 11*b* is thereby pressed so as to fix the throttle valve 1 in the fully-closed position, thereby preventing the throttle valve 1 from being accidentally opened, for example, by a negative engine suction pressure. The risk of a serious accident such as self-speeding of the vehicle during "abnormal-state auxiliary driving" can be thereby reduced and a complete fail-safe function and improved reliability of the control system can be achieved.

Figure 10:
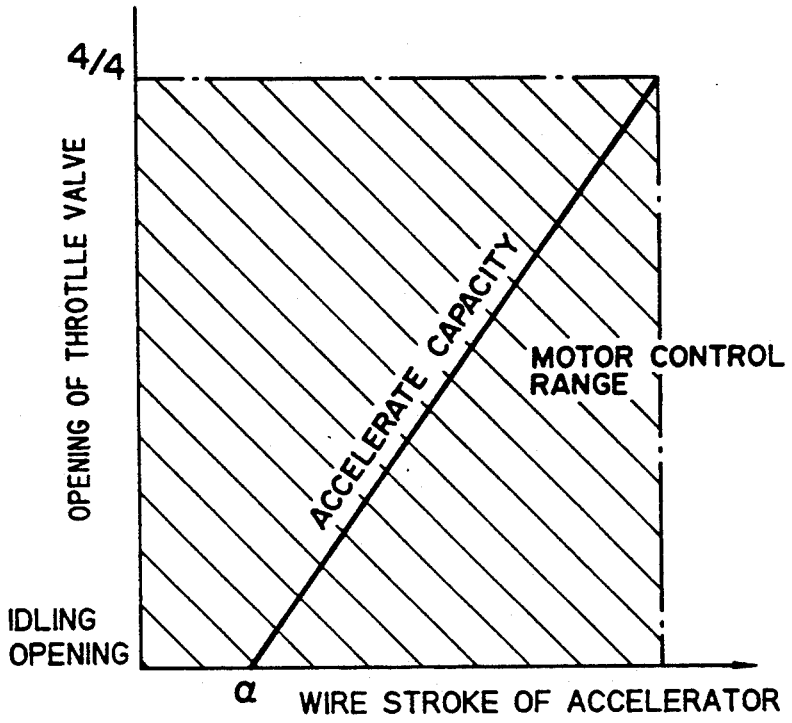
FIG. 10 is a characteristic diagram showing a controllable range in accordance with the fifth embodiment of the invention.

FIG. 10 shows a controllable range of the embodiment of FIG. 9. As is apparent from FIG. 10, the throttle valve 1 can be controlled with the motor 6 through the overall range of its opening. It is also understood that the possible control range is the same as that in the conventional art in the "abnormal-state auxiliary drive" mode, and that a control in compliance with the acceleration pedal operation can be effected in the range of throttle lever angles equal to or larger than the angle $\alpha$.

Next, the relationship between the movement of the throttle valve 1 and the movement of the accelerator lever 11*b* during "abnormal-state auxiliary driving" will be described below with reference to FIG. 11.

Figure 11:
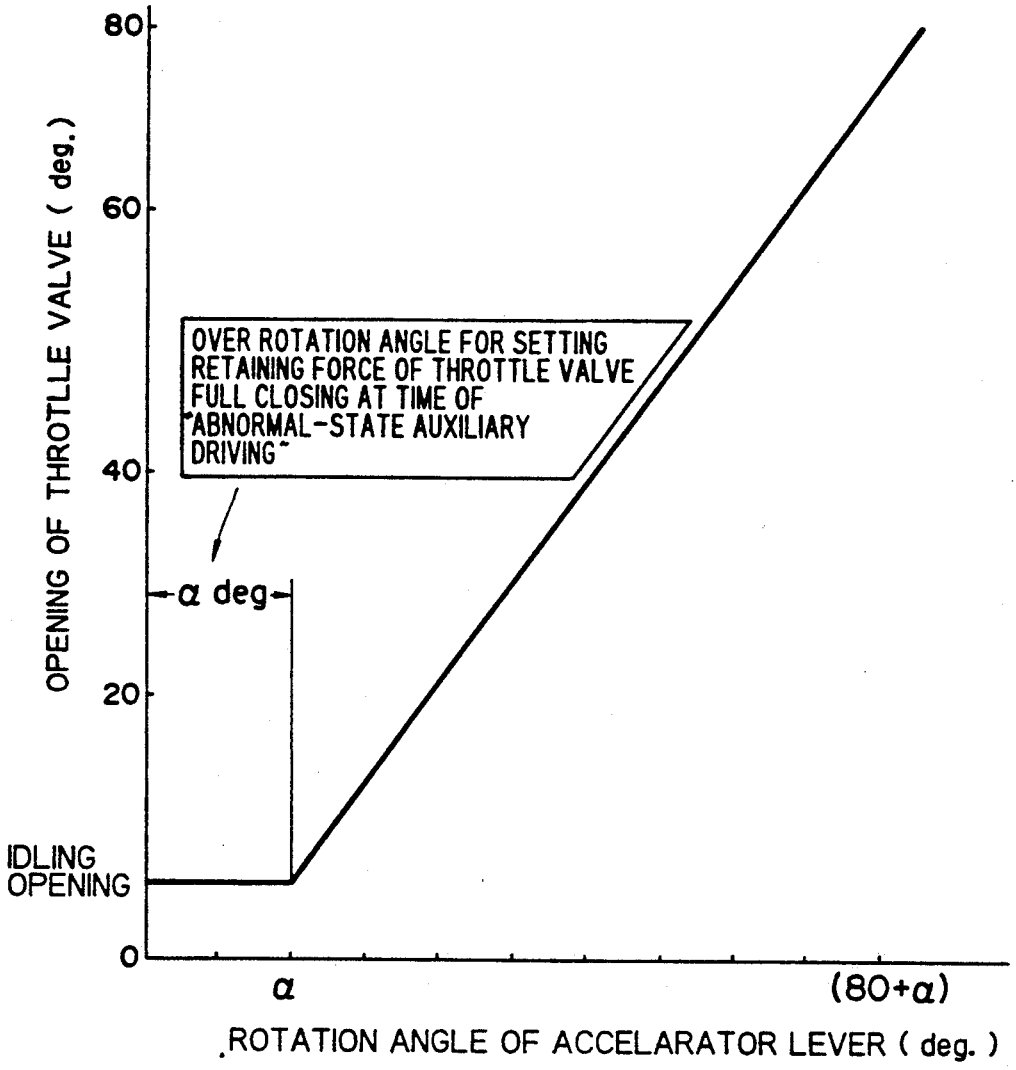
FIG. 11 is a characteristic diagram of a throttle valve and a throttle lever of the fifth embodiment of the invention.

In this embodiment, as is apparent from FIG. 11, an insensible range is provided in the range of movement of the control lever 11*a*, i.e., the opening of the throttle valve 1 at an initial stage of the accelerator pedal operation or, in other words, when the angle of rotation of the accelerator pedal 11*b* is $\alpha°$ or smaller.

This insensible range is set by applying a restraining force to the throttle valve 1 at the full-closure opening. It can be understood that the risk of a serious accident such as self-speeding of the vehicle can be thereby reduced and a complete fail-safe function and improved reliability of the control system can be achieved.

Also, the vehicle driver can feel a change to "abnormal-state driving" by the emergence of this insensible range in the accelerator pedal operation.

Thus, in this embodiment, at the time of occurrence of an abnormality, the motor 6 is disconnected from the throttle valve shaft 3 to automatically change the throttling operation into the mode under the opening control using the accelerator pedal 14 to change the opening of the throttle valve 1 by the operation of the accelerator pedal 14 while automatically setting the opening in accordance with the operated position of the accelerator pedal 14, thereby starting the "abnormal-state auxiliary drive" function. Also, since the throttle valve 1 is held by being pressed with a predetermined resiliency force to the full-closure opening end thereof when the accelerator pedal 14 is fully returned, the occurrence of a serious accident such as self-speeding of the vehicle during "abnormal-state auxiliary driving" can be prevented, thus achieving a complete fail-safe function and improved reliability of the control system.

According to the present invention, a throttle valve controller of an internal combustion engine can be provided which has a construction advantageous in terms of cost and enables, by a fail-safe function, "abnormal-state auxiliary driving" performed by the accelerator pedal operation in a case where an abnormality such as a failure has occurred in the actuator driving system. The risk of occurrence of a serious accident such as self-speeding of the vehicle is thereby eliminated substantially completely, and a complete fail-safe function and improved reliability of the control system can be achieved.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A throttle valve control method, comprising the steps of providing a driving force connection/disconnection between a throttle valve and an actuator for actuating the throttle valve automatically, opening and closing the throttle valve manually when the throttle valve and actuator are disconnected, and transmitting a driving force between the throttle valve when manual opening and closing thereof occurs such that a difference between an opening of the throttle valve when automatically actuated and another opening of the throttle valve when manually actuated is absorbed during the driving force transmitting step.

2. A throttle valve controller for an internal combustion engine, comprising:

an actuator for operating a throttle valve to be opened and closed;

a driving force connection/disconnection apparatus provided between an opening/closing drive member of the throttle valve and a driving force output member of said actuator;

the throttle valve being capable of operating to be opened and closed by the operation of an accelerator pedal when said actuator is disconnected from said opening/drive member of the throttle valve; and a fluid driving force transmitter provided at a driving force connection between a ember displaced with the operation of the accelerator pedal and said opening/driving member of the throttle valve;

wherein a difference between an opening of the throttle valve controlled with said actuator and another opening to which the throttle valve is to be set by the operation of the accelerator pedal is absorbed by said fluid driving force transmitter.

3. An internal combustion engine throttle valve controller according to claim 2, wherein said fluid driving force transmitter comprises a driving force transmission mechanism including a fluid cylinder and an electromagnetic valve provided in a passage for communication between the fluid cylinder and outside thereof, said opening difference being absorbed by a displacement between the fluid cylinder and a piston when the electromagnetic valve is open.

4. A throttle valve controller for an internal combustion engine, comprising:

an actuator for operating a throttle valve to be opened and closed;

a driving force connection/disconnection apparatus provided between an opening/closing drive member of the throttle valve and a driving force output member of said actuator;

the throttle valve to be opened and closed being configured to operate via an accelerator pedal when said actuator is disconnected from said opening/closing drive member of the throttle valve; and a flexing driving force transmitter provided at a driving force connection between a member displaced with the operation of the accelerator pedal and said opening/driving member of the throttle valve;

wherein a difference between an opening of the throttle valve controlled with said actuator and another opening to which the throttle valve is to be set by the operation of the accelerator pedal is absorbed by said flexing driving force transmitter.

5. A throttle valve controller according to claim 4, wherein said flexing driving force transmitter comprises a spring driving force transmission mechanism having a pair of springs arranged to be displaced in opposite directions and a preliminary stress applied thereto, said opening difference being absorbed by the displacements of said pair of springs in opposite directions.

6. A throttle valve controller according to claim 4, wherein said flexing driving force transmitter comprises a spring driving force transmission mechanism having one spring displaceable in each of plus and minus directions from a neutral state, said opening difference being absorbed by a displacement of said spring.

7. A throttle valve controller according to claim 4, wherein said driving force connection/disconnection apparatus comprises an electromagnetic clutch mechanism.

8. A throttle valve controller according to claim 7, wherein said flexing driving force transmitter comprises a spring driving force transmission mechanism having a pair of springs arranged to be displaced in opposite directions and a preliminary stress applied thereto, said opening difference being absorbed by the displacements of said pair of springs in opposite directions.

9. A throttle valve controller for an internal combustion engine, comprising:

an actuator for controlling opening/closing positions of a throttle valve;

a driving force connection/disconnection apparatus provided between an opening/closing drive member of the throttle valve and a driving force output member of said actuator;

a flexing driving force transmission mechanism for connecting a member displaced with the operation of the accelerator pedal and said opening/closing drive member of the throttle valve;

said flexing driving force transmission mechanism absorbing a difference between an opening of the throttle valve controlled with said actuator and another opening to which the throttle valve is to be set by the operation of the accelerator pedal; and said throttle valve being capable of operating to be opened and closed by operation of an accelerator pedal when said actuator is disconnected from said opening/closing drive member of the throttle valve by said driving force connection/disconnection apparatus;

wherein a fully closed position of the throttle valve determined by said opening/closing drive member of the throttle valve is set so as to avoid attaining the maximum return position of said member displaced with the operation of said accelerator pedal.

10. A throttle valve controller according to claim 9, wherein said flexing drive force transmission mechanism comprises a pair of springs arranged to be displaced in opposite directions and to each have a preliminary stress, said opening difference being absorbed by the displacements of said pair of springs in opposite directions.

11. A throttle valve controller according to claim 9, wherein said driving force connection/disconnection apparatus comprises an electromagnetic clutch mechanism.

12. In a throttle valve controller, the improvement comprising a driving force transmitter arranged to be operatively connected between a member displaceable manually and an opening/driving member of a throttle valve such that a difference between an opening of the throttle valve and another opening to which the throttle valve is to be set by manual operation is absorbed by the driving force transmitter.

13. The throttle valve controller according to claim 12, wherein the transmitter is a flexing driving force transmitter.

14. The throttle valve controller according to claim 12, wherein the transmitter is a fluid driving force transmitter.

* * * * *